US006314838B2

(12) United States Patent
Wall

(10) Patent No.: US 6,314,838 B2
(45) Date of Patent: Nov. 13, 2001

(54) RATCHETING MECHANISM

(76) Inventor: Dean Wall, 11106 Susan Dr., Sandy, UT (US) 84092

( * ) Notice: Subject to any disclaimer, the term of this patent is extended or adjusted under 35 U.S.C. 154(b) by 0 days.

(21) Appl. No.: 09/373,325

(22) Filed: Aug. 12, 1999

(51) Int. Cl.[7] ..... B25B 13/00
(52) U.S. Cl. ..... 81/58.4; 81/60
(58) Field of Search ..... 81/58.4, 60, 61, 81/62, 63.1; 192/43, 43.2, 43.1

(56) References Cited

U.S. PATENT DOCUMENTS 5,379,873 * 1/1995 Shiao ..... 192/43
5,582,081 * 12/1996 Lin ..... 81/63.1
5,806,381 * 9/1998 Lin ..... 81/58.4
5,910,196 * 6/1999 Huang ..... 81/60
6,047,801 * 4/2000 Liao ..... 192/43.2

* cited by examiner

*Primary Examiner*—James G. Smith
*Assistant Examiner*—Hadi Shakeri
(74) *Attorney, Agent, or Firm*—Jon Christianson

(57) ABSTRACT

The invention is an improved ratcheting mechanism having a rotatable wheel with teeth, a shaft to which the wheel is affixed, at least two toggles, each with an arm for engaging a tooth of said wheel and each with an arched structure. The arched structure forms an arch over the shaft. There is also a contact for contacting either toggle to cause the arm of the contacted toggle to disengage from a tooth of the wheel and to allow rotation of the wheel in one rotational direction.

20 Claims, 6 Drawing Sheets

RATCHETING MECHANISM

This invention is an improved ratcheting mechanism that can be used in a variety of applications, including, without limitation, in a multiple bit T-driver. To understand the invention it is useful to first understand the prior art. It is an object of this invention to provide an improved ratcheting mechanism. It is a further object of this invention to provide an improved toggle for a ratcheting mechanism.

BACKGROUND AND PRIOR ART

A prior art T-driver is disclosed in U.S. Pat. No. 4,848,197 entitled "Multiple Bit Handtool" issued Jul. 18, 1989. U.S. Pat. No. 4,848,197 and its disclosures and drawings are incorporated herein by this reference.

A prior art ratcheting mechanism can be incorporated into the prior art T-driver of U.S. Pat. No. 4,848,197. This is known in the prior art. A prior art T-driver with a prior art ratcheting mechanism is shown in FIGS. 1, 2, 3 and 4 and is described below.

FIG. 1 shows a first elongated barrel 1 and a second elongated barrel 2. Barrel 2 is rotatably attached to barrel 1. Pin 3 provides the means by which the barrels are rotatably attached. Although barrels 1 and 2 are substantially cylindrical (i.e. substantially circular cross-section) this is not a requirement. The elongated barrels may have rectangular, triangular, oval or other-shaped cross-sections. Furthermore, the cross-sectional size and shape of a barrel may be different for different portions of the barrel.

Both ends of barrel 2 have bit holding means to receive and hold bits. One end of barrel 1 also has a bit holding means to receive and hold bits. The bit holding means of barrel 1 is in spindle 12 through an end hole at 13. Each of the bit holding means can be openings of barrel 2 and spindle 12 that are shaped and sized to receive and hold a bit. In this embodiment, the opening has a hexagonal cross-section and is adapted to accept and hold bits 4, 5 and 6. FIG. 1 depicts double-headed bits 4, 5 and 6. The main body of each bit has a hexagonal cross-section for a friction fit into the bit holding means. Resilient rings, magnets, springs, spring balls and the like can also be used to facilitate or enable a holding fit for bit-holding purposes. The T-driver is not limited to the bit-holding means described or shown as any means capable of accepting and holding a bit on the end of a barrel can be used. For example, the bit-holding means can be a threaded cylindrical portion onto which a threaded (single-headed) bit is screwed. The exposed heads or ends of the bits can be covered with protective caps (not shown).

Double-headed bits are preferred because they give the user of the handtool a greater number of available tool options without the need for carrying extra bits. A double-headed bit can be removed from the bit-holding means, reversed and inserted back into the bit-holding means to make a different bit head available for use. There is no preferred selection of bits (as such preference is a matter of choice by the user) but one useful selection of double-headed screwdriver bits is comprised of the numbers 1, 2 and 3 Phillips heads paired respectively with the number 6 slotted, number 4 slotted and number 10 slotted flat-heads. The bits useful in the T-driver are not limited to screwdriver head bits and can include any other kind of bit or tool (for example, socket wrench heads, Allen wrench, butterfly, torque, star and other bit tips).

A portion la (see FIG. 1) of barrel 1 is open, hollow and adapted to receive an end of barrel 2. Barrel 2 can be rotated (for example from a T-position as shown in FIG. 5) into (and nested in) the open area of portion 1 a to assume a "straight" position. A tight fit allows barrel 2 to hold whichever position (including an intermediate position) it is given by the user of the tool.

When the T-driver is in the perpendicular or T-position of FIG. 5, it is capable of producing a great deal more torque than a normal screwdriver or socket set. It also will provide more turning radius than a standard screwdriver or socket set. Considering its greater turning radius, it can apply the increased torque for a longer period of time in each rotation.

In use, the T-driver is functionally designed for barrel 2 to be placed across the palm of the hand with barrel 1 extending perpendicularly outwardly with two fingers on either side. An optional position has barrel 2 placed below the index finger. When high torque is not necessary, the T-driver can be used in the "straight" position and may be twisted with the fingers.

The dimensions of this T-driver can vary widely. The T-driver (bits excluded) in the depicted embodiment is about 5.75 inches long in the straight position. Barrel 1 is about 4.25 inches long and barrel 2 is about 2.25 inches long.

Incorporated into the prior art T-driver is a ratcheting mechanism having a rotatable wheel 10 with teeth 11. The rotatable wheel 10 is at the end of a spindle 12 (including shaft 91). The wheel 10, teeth 11 and spindle 12 are inserted into an open end of barrel 1 (i.e., the end that is opposite the end where barrel 2 is rotatably attached to barrel 1). The spindle 12 has an increased diameter (or head) at 13. The diameter of 13 is greater than the diameter of the opening into barrel 1 through which spindle 12 is inserted. After insertion of wheel 10, teeth 11 and spindle 12 into barrel 1, a key 14 is inserted into an opening (not shown) in barrel 1 to secure spindle 12 to barrel 1. Key 14 maintains a friction fit with the opening and prevents spindle 12 from sliding out of barrel 1.

The ratcheting mechanism further includes toggles 20 each with an arm 21 and a dimple 22. The toggles 20 (also shown as 20*a* and 20*b*) are positioned relative to each other in the manner shown in FIG. 2. The arms 21 form an opening for tooth 11*a* as shown in FIG. 2. Tooth 11*a* is one of teeth 11. A spring 24 is mounted on toggles 20. A switch is mounted on spring 24. The switch has a switch plate 27, a switch knob 28 for thumb or finger contact, and an extension 29 for insertion into hole 25 of spring 24. Extension 29 and hole 25 are sized and shaped such that hole 25 receives and accommodates extension 29. A sleeve 17 is positioned over barrel 1 and switch plate 27. Sleeve 17 has an opening 18 sized and shaped to accommodate switch knob 28 and to allow it to extent through sleeve 17 where it can be accessed by a human thumb or finger.

Pressure (e.g., by thumb or finger) on switch knob 28 causes switch plate 27, extension 29 and spring 24 to move in either direction along a path parallel to the length of elongated barrel 1, as shown by arrow 19 in FIG. 4. Switch 28 can be moved to any one of three positions. There is a tab 99 on each side of knob 28. Tabs 99 work with the shape of hole 18 in sleeve 17 to select the desired switch position. When the switch is moved to the first position, extension 29 pushes spring 24 into contact with dimple 22 of one of the toggles (e.g., toggle 20*a*). When moved to the second position, extension 29 pushes spring 24 into contact with dimple 22 of the other toggle (e.g., toggle 20*b*). When moved to the third position, the extension 29 and spring 24 are in an intermediate position between the first and second positions, and there is no significant contact with the dimple 22 of either toggle.

When switch 28 is in the third position, both arms 21 of toggles 20 engage one tooth (shown as 11*a* in FIG. 3) of teeth 11. The arms 21 engage tooth 11*a* on opposite sides of tooth 11*a* and prevent wheel 10 from rotating in either direction. Thus, bit 4 when inserted in spindle 12 can be turned by the T-driver in either direction to act on (e.g., turn) a screw or other device. There is no "give" in either rotational direction.

When switch 28 is moved to the first position, spring 24 makes contact with dimple 22 of toggle 20*a* and forces arm 21 of toggle 20*a* to lift and disengage from teeth 11 (e.g., from tooth 11*a*). With this arm disengaged, wheel 10 is free to rotate in one direction (i.e., the top of wheel 10 in FIG. 3 can rotate towards the disengaged arm) but not in the other direction. FIG. 4 shows this first position and shows contact area 23 of spring 24 contacting dimple 22 and causing arm 21 of toggle 20*a* to lift and disengage from teeth 11. In this position, bit 4 (when inserted in spindle 12) can be turned by the T-driver in only one rotational direction that acts on a screw or other device. This rotational direction is caused by the engaged arm 21 acting on tooth 11*a* and pushing it in a rotational direction towards the disengaged arm 21. There is "give" in the opposite rotational direction (i.e., the bit can't act on (e.g., turn) the screw or other device in the opposite rotational direction) because the disengaged arm 21 is not in position to engage and push tooth 11*a*. This allows the user of the T-driver through repeated back and forth operational motions of the hand and wrist to turn the screw (or other device) in one direction, with each return motion having no turning action or effect on the screw or other device, because the return motion is in the opposite rotational direction that "gives."

When switch 28 is moved to the second position, spring 24 ceases contact with dimple 22 of toggle 20*a* and then makes contact with dimple 22 of toggle 20*b*, which forces arm 21 of toggle 20*b* to lift and disengage from teeth 11 (e.g., from tooth 11*a*). With this arm disengaged, wheel 10 is free to rotate in the opposite direction (i.e., opposite to the direction of rotation when switch 28 is in the first position). In this position, bit 4 (when inserted in spindle 12) can be turned by the T-driver in only one rotational direction that acts on a screw or other device. This rotational direction is the opposite to that of the first switch position. Similar to the description above for the first position, but with the engagement of arms 21 reversed, the rotational direction that can act on (e.g., turn) a screw or other device is caused by the engaged arm 21 of toggle 20*a* to act on tooth 11*a* and push it in a rotational direction towards the disengaged arm 21 of toggle 20*b*. There is "give" in the opposite rotational direction (i.e., the bit can't act on (e.g., turn) the screw or other device in the opposite rotational direction) because the disengaged arm 21 is not in position to engage and push tooth 11*a*. In a similar manner to the first switch position, but in the opposite rotational direction, this allows the user of the T-driver through repeated back and forth operational motions of the hand and wrist to turn the screw (or other device) in one direction, with each return motion having no turning action or effect on the screw or other device, because the return motion is in the opposite rotational direction that "gives."

THE DRAWINGS

SUMMARY OF INVENTION

The invention is an improved ratcheting mechanism having a rotatable wheel with teeth (e.g., a gear), a shaft to which the wheel is affixed, at least two toggles, each with an arm for engaging a tooth of said wheel and each with an arched structure. The arched structure forms an arch over the shaft. There is also a contact for contacting either toggle to cause the arm of the contacted toggle to disengage from a tooth of the wheel and to allow rotation of the wheel in one rotational direction. The contact can contact the toggle by contacting a raised area of the toggle. Preferably, the arched structure elevates along itself and provides an elevated surface which serves as the raised area of the toggle. The contact can be a spring or any other mechanism that contacts the toggle or raised area of the toggle. The arched structure also expands in width along itself. Preferably, adjacent teeth of the wheel form a perpendicular area for receiving the arm when the arm engages one of the teeth. Preferably, the teeth are uniformly positioned around the wheel. A switch for controlling movement of the spring or other contact causes the spring or other contact to make contact with either toggle.

The invention also includes an improved toggle for a ratcheting mechanism, with the toggle being a plate with an arched structure and an arm. The arched structure provides an arch which can be positioned above a shaft to which a ratcheting wheel with teeth is attached. The arm is adapted to engage at least one of said teeth. The plate and arm are adapted to be positioned and used in a ratcheting mechanism that includes said ratcheting wheel with teeth.

The invention also includes a handtool of the T-driver type having incorporated therein the ratcheting mechanism of this invention.

DETAILED DESCRIPTION OF THE INVENTION INCLUDING PREFERRED EMBODIMENT

Figure 6:
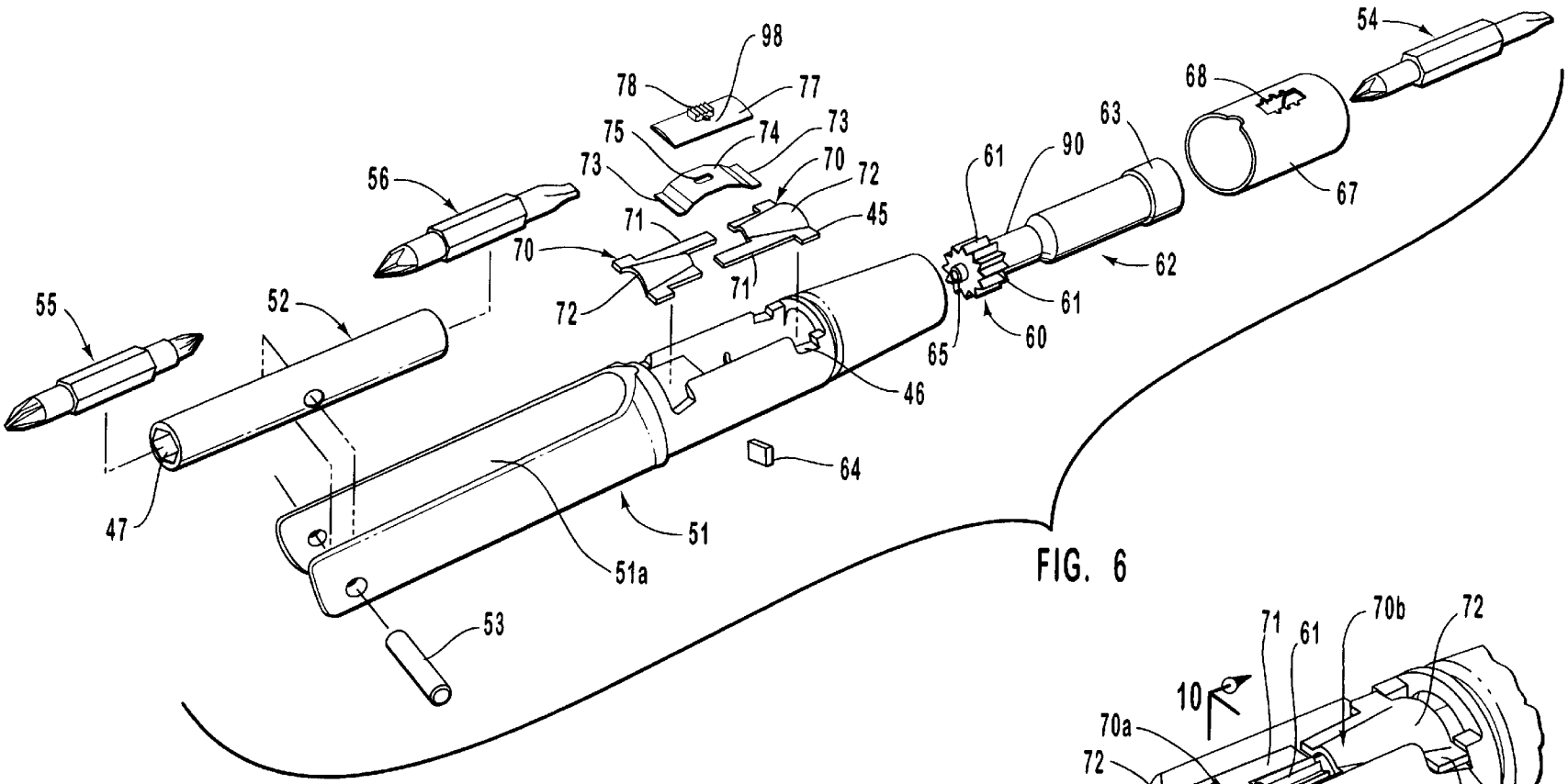
FIG. 6 depicts the parts and arrangement of a T-driver with the inventive ratcheting mechanism.

FIG. 6 shows a T-driver similar to prior art T-driver, but with an improved inventive ratcheting mechanism used in place of the prior art ratcheting mechanism. Much of the disclosure given above for the prior art also applies here, and the description of the relevant and still applicable prior art is not repeated, but such similarities are incorporated into this disclosure. However, the differences between the invention and the prior art will be apparent from this disclosure and the drawings. It should also be noted that the inventive ratcheting mechanism can be used in applications other than T-drivers.

In FIG. 6, a first elongated barrel 51 and a second elongated barrel 52 are rotatably attached in the same manner as the prior art. A pin 53 can be used for this purpose. The prior art description of the barrels and their bits, bit holding means and openings applies here. The bit holding means of barrel 51 is in spindle 62 through an end hole at 63.

Figure 5:
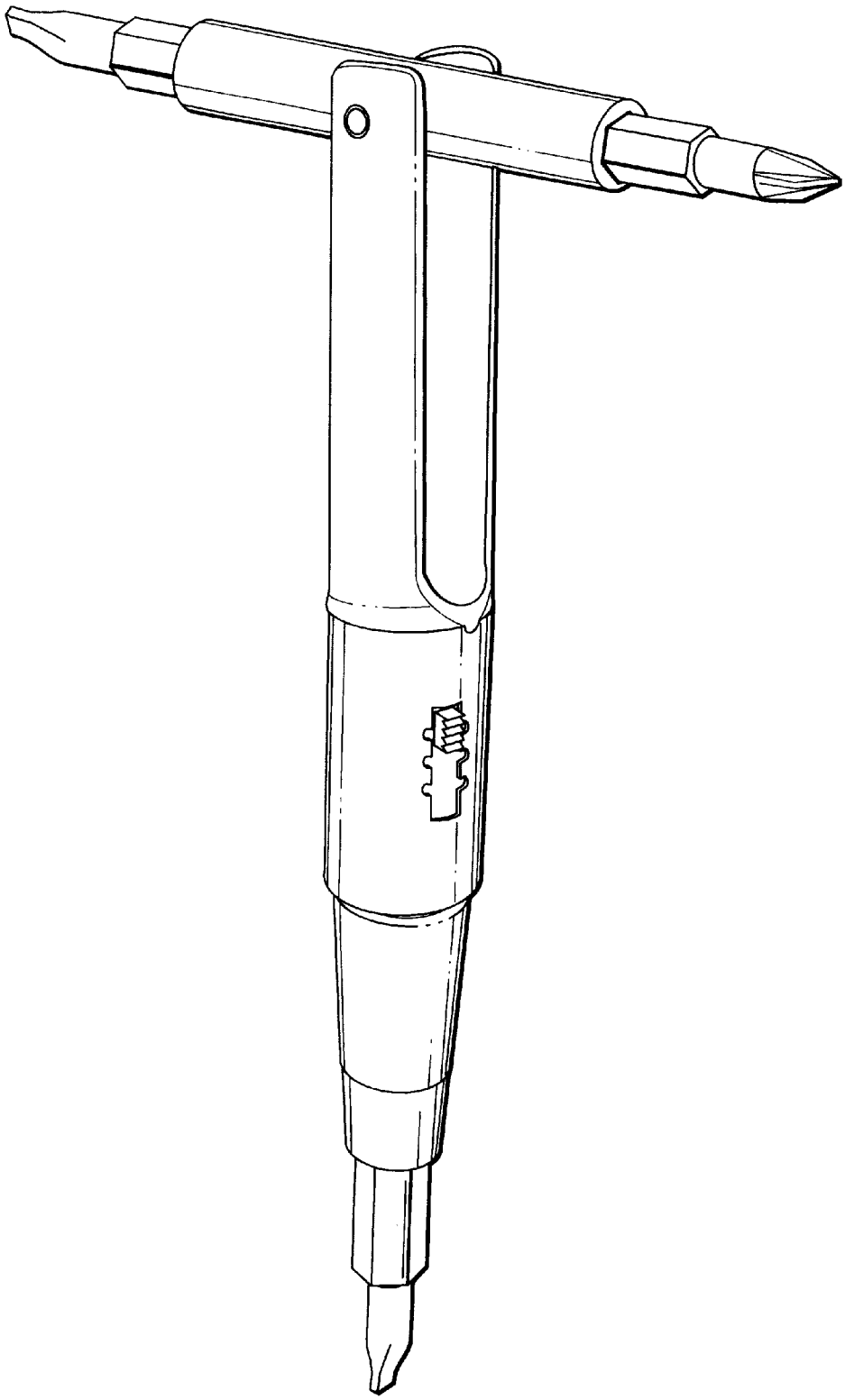
FIG. 5 depicts a T-driver which can have embodied in it either a prior art ratcheting mechanism or the improved ratcheting mechanism of this invention.

A portion 51*a* (see FIG. 6) of barrel 51 is also open, hollow and adapted to receive an end of barrel 52. Barrel 52 can be rotated (for example from a T-position as shown in FIG. 5) into (and nested in) the open area of portion 51*a* to assume a "straight" position. A tight fit allows barrel 52 to hold whichever position (including an intermediate position) it is given by the user of the tool. Other attributes, dimensions and modes of use of the T-driver as described in the prior art above also apply here.

Incorporated into this T-driver is an embodiment of my improved and inventive ratcheting mechanism. This ratcheting mechanism has a rotatable ratcheting wheel 60 having teeth 61. The rotatable wheel 60 is at the end of a spindle 62. The wheel 60 is attached to or an integral part of shaft 90. Shaft 90 is part of spindle 62. The wheel 60, teeth 61 and spindle 62 (including shaft 90) are inserted into an open end of barrel 51 (i.e., the end that is opposite the end where barrel 52 is rotatably attached to barrel 51). The spindle 62 has an increased diameter at 63 (also referred to as head 63) that contacts barrel 51 and limits insertion of spindle 62 into barrel 51. The diameter of 63 is greater than the diameter of the opening into barrel 51 through which spindle 62 is inserted. After insertion of wheel 60, teeth 61 and spindle 62 into barrel 51, a key 64 is inserted into an opening (not shown) in barrel 51 to secure spindle 62 to barrel 51. Key 64 maintains a friction fit with the opening and prevents spindle 62 from sliding out of barrel 51. Knob 65 extends from wheel 60 to better secure the wheel 60 and spindle 62 to barrel 51 (similar to prior art knob 15).

Figure 7:
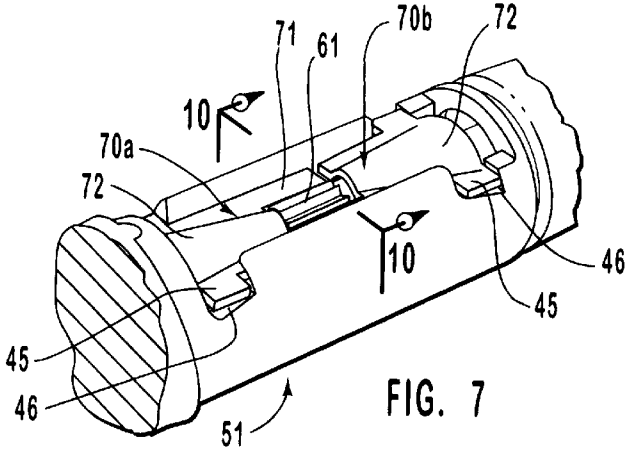
FIG. 7 depicts the arrangement of the improved inventive toggles to each other and to the teeth of the wheel, as shown in part of the first elongated barrel.
Figure 10:
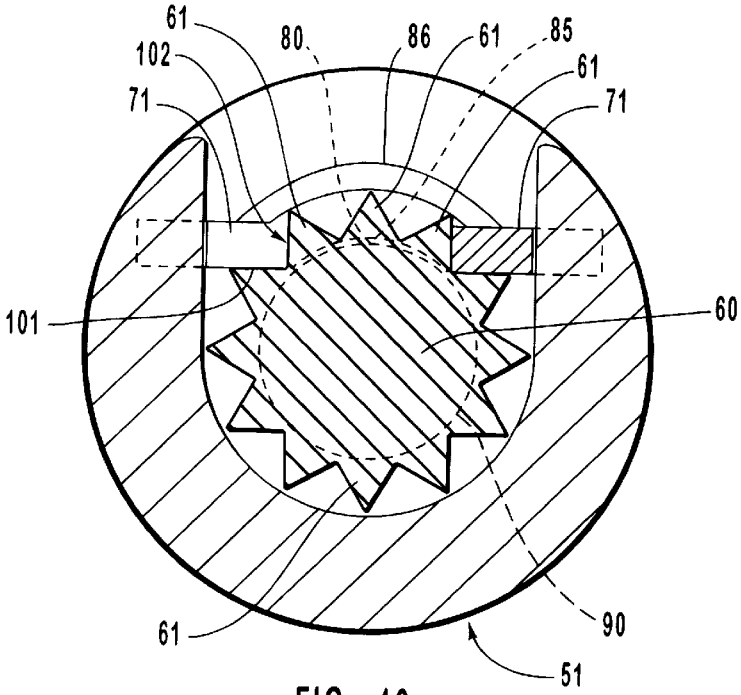
FIG. 10 depicts an end view of the wheel and its teeth in relation to the arms of the toggles, as implemented in the invention.

The ratcheting mechanism further includes toggles 70 each with an arm 71 and an arched structure 72 that extends across the toggle. The toggles 70 (also shown as 70*a* and 70*b*) are positioned relative to each other in the manner shown in FIG. 7. The arms 71 form an opening for some of teeth 11 as shown in FIG. 7 and 10. The arched structure 72 of each toggle 70 allows toggle 70 to be arched over shaft 90. This arch allows the arms 71 to be lower relative to the apex 80 of shaft 90 than would otherwise be the case if the arch were not present. In this manner the arched structure 72 of toggle 70 provides an arch above the spindle 62 and in particular above shaft 90. In contrast, the prior art toggle 20 is not arched at the front of the toggle 20. Toggle 20 only has a dimple 22 at the rear of toggle 20, but this is not an arched structure for the purposes of this invention. The front portion of prior art toggle 20 is flat, rather than arched. Therefore, without an arched structure, toggle 20 does not provide for arching over shaft 90 and does not allow arms 21 to be lowered relative to the apex 81 of the wheel 10 and teeth 11 (i.e., arms 21 cannot be given a lower position relative to apex 81).

Figure 8:
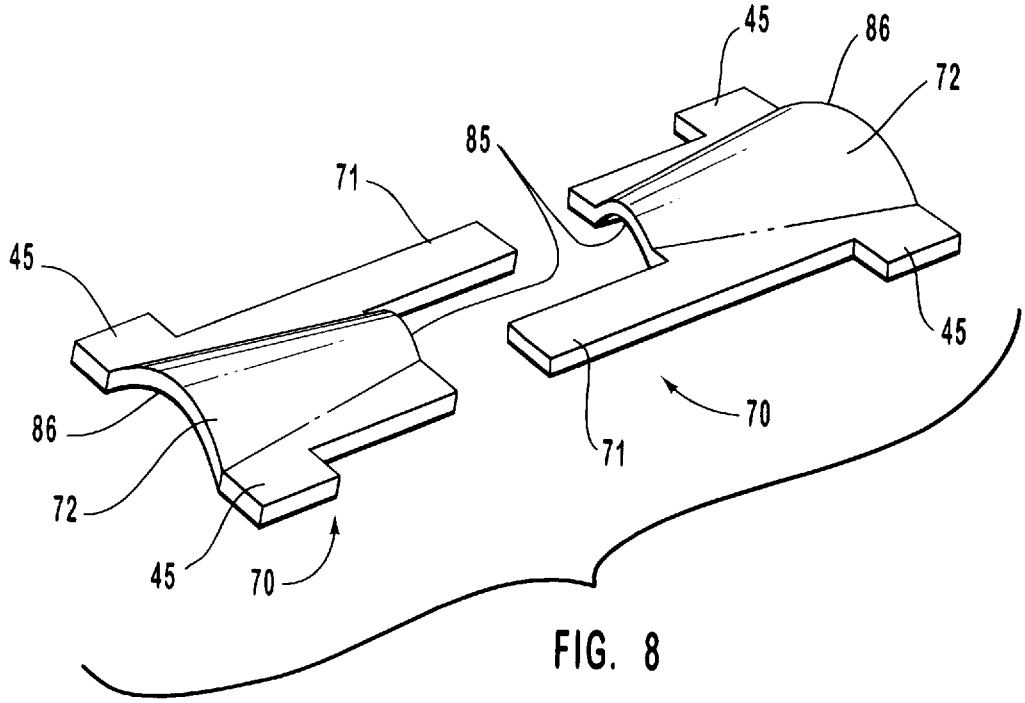
FIG. 8 depicts the inventive toggles.
Figure 9:
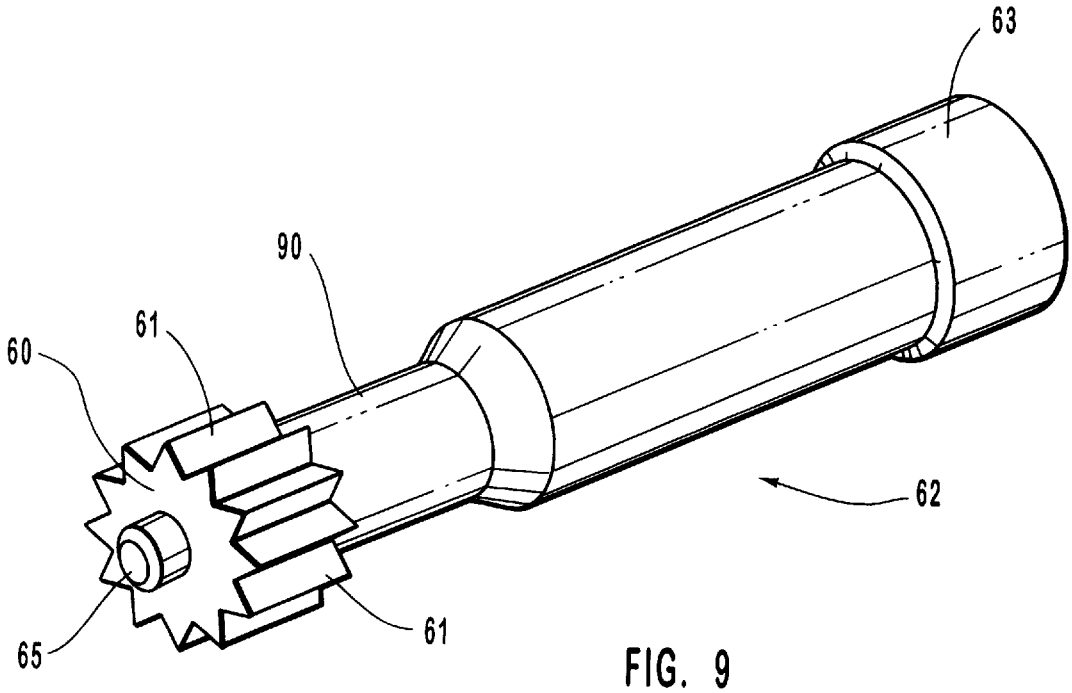
FIG. 9 depicts the spindle (shaft), wheel, and teeth of the invention.
Figure 11:
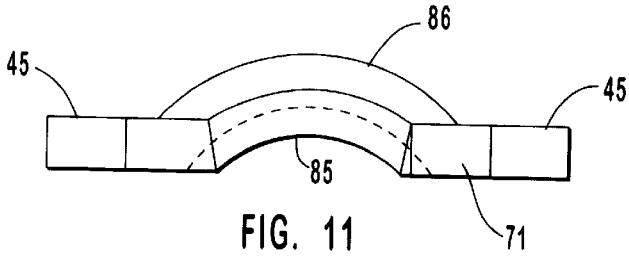
FIG. 11 depicts a side view of an improved inventive toggle.

In this embodiment of the invention, the arched structure 72 extends from the front of toggle 70 to the rear of toggle 70. As the arched structure 72 extends to the rear of toggle 70, the arched structure 72 continues to elevate (i.e. to rise) and to expand in width, as shown in FIGS. 8 and 11. In other words, the elevation and expansion of arched structure 72 increases from 85 to 86 as shown in FIG. 8. With respect to increasing elevation, the arched structure 72 "elevates along itself." This elevation (or rise) provides a raised area of toggle 70 which replaces the dimple 22 of the prior art toggle 20. The increase in elevation provides an elevated surface or raised area that can be contacted by the contact area 73 of spring 74 to cause an arm 71 to disengage from a tooth 61. The terms expansion and expand are used herein with respect to arched surface 72 to describe the expansion in the width of arched structure 72, and such terms are not used to describe the elevation or rise of arched structure 72. As seen in FIG. 8, the arched structure 72 expands in width along itself because the width of arched structure 72 increases from front to rear (i.e., the width of arched structure 72 at its rear is greater than the width of arched structure 72 at its front).

Toggles 70 are mounted in the body of the T-driver as shown in the FIGS. 6 and 7. Each toggle 70 has two supports 45 that are aligned with support areas 46. A spring 74 is mounted on toggles 70. A switch is mounted on spring 74. The switch has a switch plate 77, a switch knob 78 for thumb or finger contact, and a switch plate extension (same as 29 in FIG. 4)) for insertion into hole 75 of spring 74. The switch plate extension and hole 75 are sized and shaped such that hole 75 receives and accommodates the extension. A sleeve 67 is positioned over barrel 51 and switch plate 77. Sleeve 67 has an opening 68 sized and shaped to accommodate switch knob 78 and to allow it to extent through sleeve 67 where it can be accessed by a human thumb or finger.

Figure 1:
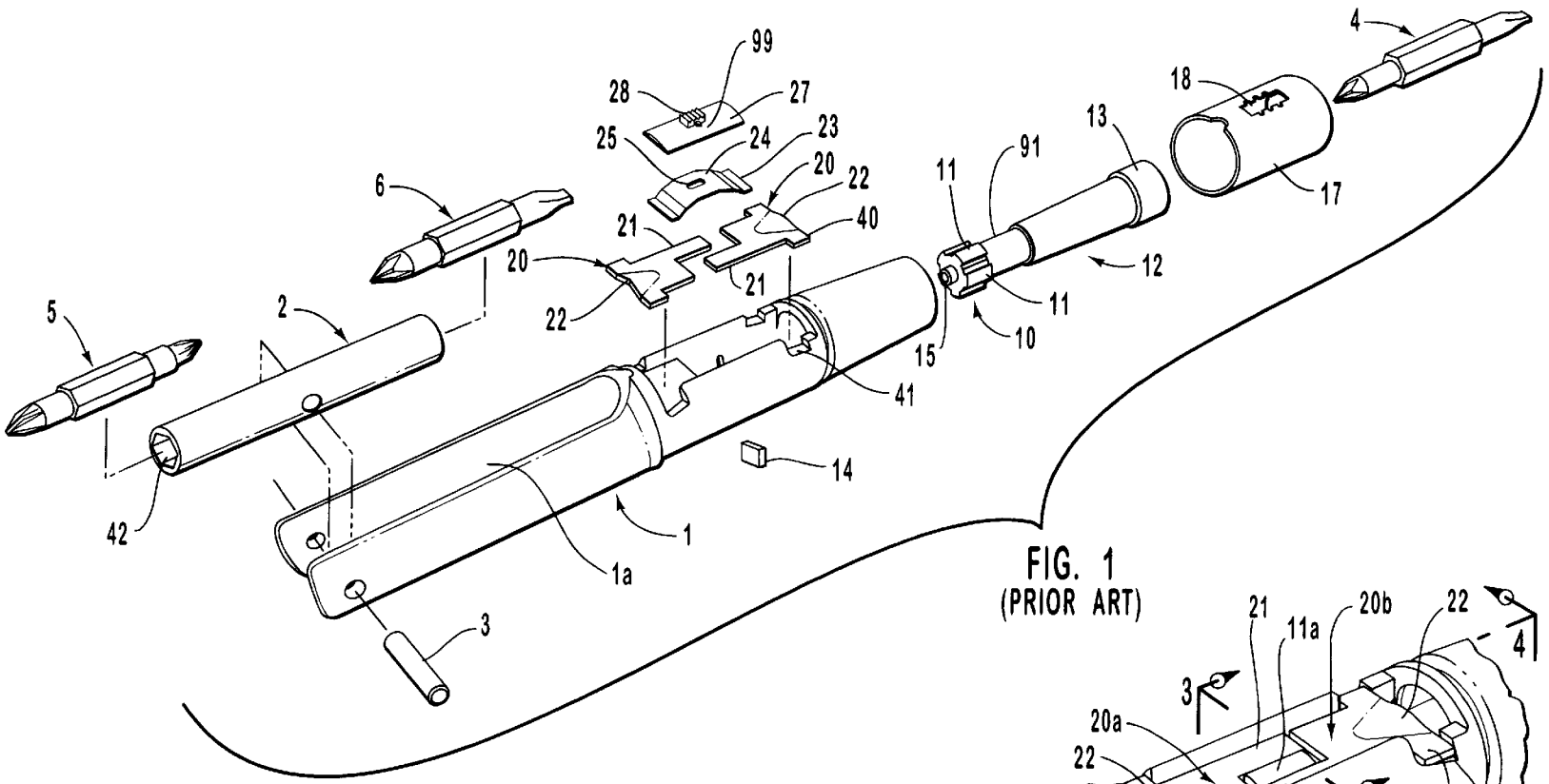
FIG. 1 (PRIOR ART)
FIG. 1 depicts the parts and arrangement of a prior art T-driver, including a prior art ratcheting mechanism.
Figure 2:
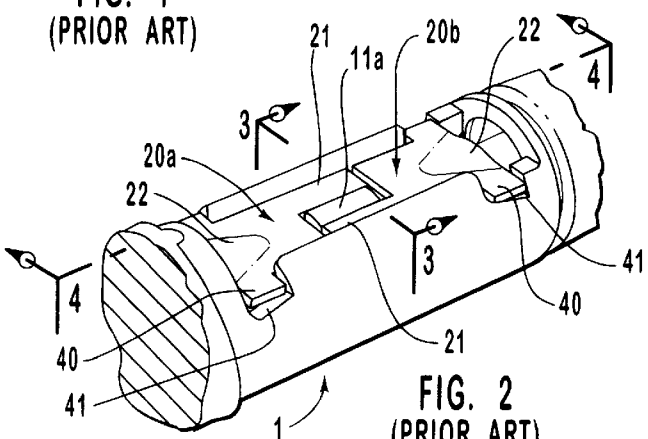
FIG. 2 (PRIOR ART)
FIG. 2 depicts the arrangement of prior art toggles to each other and to one tooth of the spindle wheel, as shown in part of the first elongated barrel.
Figure 3:
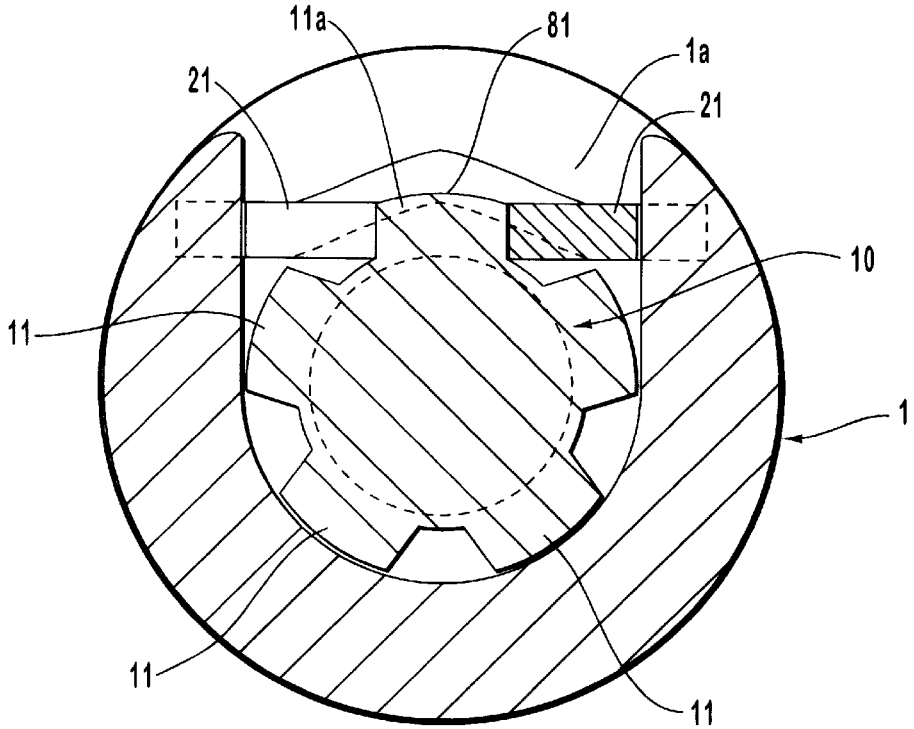
FIG. 3 (PRIOR ART)
FIG. 3 depicts an end view of the prior art spindle wheel and its teeth in relation to the arms of the toggles.
Figure 4:
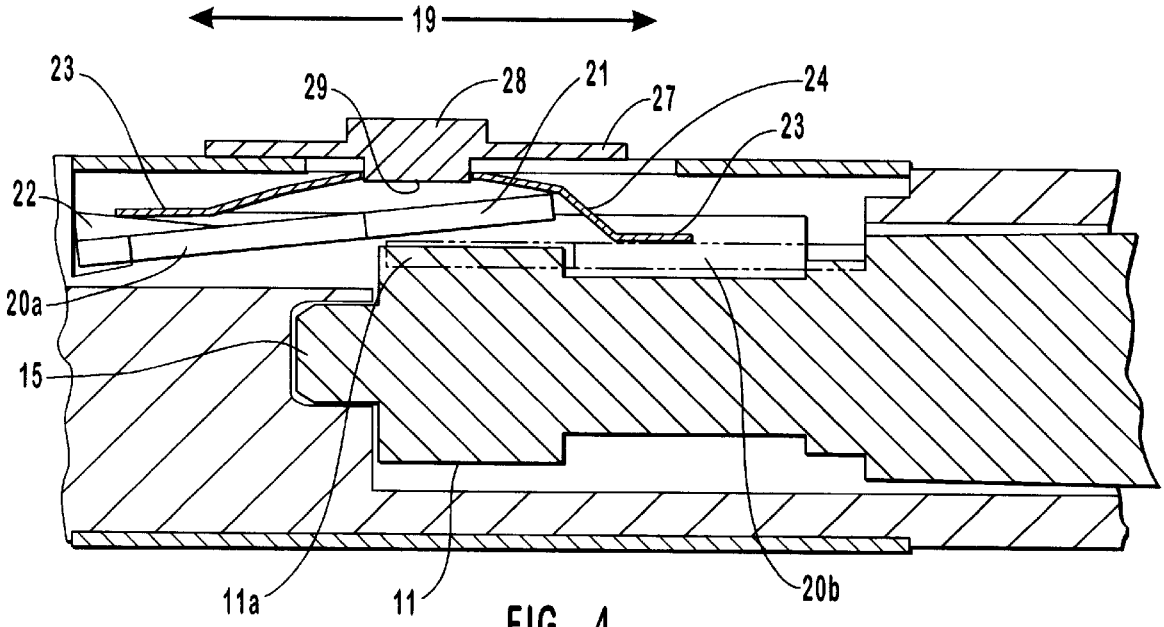
FIG. 4 (PRIOR ART)
FIG. 4 depicts a side view of the prior art ratcheting mechanism.

Pressure (e.g., by thumb or finger) on switch knob 78 causes switch plate 77, switch plate extension, and spring 74 to move in either direction along a path parallel to the length of elongated barrel 51 (same as shown by arrow 19 in FIG. 4). The switch can be moved to any one of three positions. There is a tab 98 on each side of knob 78. Tabs 98 work with the shape of hole 68 in sleeve 67 to select the desired switch position. When the switch is moved to the first position, the switch plate extension pushes spring 74 into contact with the elevated surface of arched structure 72 of one of the toggles (e.g., toggle 70*a*). When the switch is moved to the second position, the switch plate extension pushes spring 74 into contact with the elevated surface of arched structure 72 of the other toggle (e.g., toggle 70*b*). When the switch is moved to the third position, the switch (including knob 78, plate 77 and switch plate extension) and spring 74 are in an intermediate position between the first and second positions, and there is no significant contact with the elevated surface of arched structure 72 of either toggle.

When the switch is in the third position, both arms 71 of toggles 70 engage teeth 61 as shown in FIG. 10. Arm 71 on the left of FIG. 10 engages a tooth 61 and prevents wheel 60 from rotating in a counter-clockwise direction. Arm 71 on the right of FIG. 10 engages a tooth 61 and prevents wheel 60 from rotating in a clockwise direction. In this manner rotation in either direction is prevented. Thus, bit 54 when inserted in spindle 62 can be turned by the T-driver in either direction to act on (e.g., turn) a screw or other device. There is no "give" in either rotational direction.

When the switch is moved to the first position, spring 74 makes contact with the elevated surface of arched structure 72 of toggle 70*a* and forces arm 71 of toggle 70*a* to lift and disengage from teeth 61. With this arm disengaged, wheel 60 is free to rotate in one direction (i.e., the top of wheel 60 in FIG. 10 can rotate towards the disengaged arm) but not in the other direction. More specifically, the contact area 73 of spring 74 contacts the elevated surface of arched structure 72 and causes arm 71 of toggle 70*a* to lift and disengage from teeth 61. In this position, bit 54 (when inserted in spindle 62) can be turned by the T-driver in only one rotational direction that acts on a screw or other device. This rotational direction is caused by the engaged arm 71 acting on a tooth 61 and pushing it in a rotational direction towards the disengaged arm 71. There is "give" in the opposite rotational direction (i.e., the bit can't act on (e.g., turn) the screw or other device in the opposite rotational direction) because the disengaged arm 21 is not in position to engage and push a tooth 61. This allows the user of the T-driver through repeated back and forth operational motions of the hand and wrist to turn the screw (or other device) in one direction, with each return motion having no turning action or effect on the screw or other device, because the return motion is in the rotational direction that "gives."

When the switch is moved to the second position, spring 74 ceases contact with the elevated surface of arched structure 72 of toggle 70*a* and then makes contact with the elevated surface of arched structure 72 of toggle 70*b*, which forces arm 71 of toggle 70*b* to lift and disengage from tooth 61. With this arm disengaged, wheel 60 is free to rotate in the opposite direction (i.e., opposite to the direction of rotation when switch 78 is in the first position). In this position, bit 54 (when inserted in spindle 62) can be turned by the T-driver in only one rotational direction that acts on (e.g., turns) a screw or other device. This rotational direction is opposite to that of the first switch position. Similar to the description above for the first position, but with the engagement of arms 71 reversed, the rotational direction that can act on (e.g., turn) a screw or other device is caused by the engaged arm 71 of toggle 70*a* to act on tooth 61 and push it in a rotational direction towards the disengaged arm 71 of toggle 70*b*. There is "give" in the opposite rotational direction (i.e., the bit can't act on (e.g., turn) the screw or other device in the opposite rotational direction) because the disengaged arm 71 is not in position to engage and push tooth 61. In a similar manner to the first switch position, but in the opposite rotational direction, this allows the user of the T-driver through repeated back and forth operational motions of the hand and wrist to turn the screw (or other device) in one direction, with each return motion having no turning action or effect on the screw or other device, because the return motion is in the opposite rotational direction that "gives."

By employing an arched structure 72, it is possible for the arms 71 of toggle 70 to assume a lower position relative to apex 80 without decreasing the diameter of the shaft 90. A decrease in the diameter of shaft 90 would adversely impact the strength and structural integrity of the shaft (and spindle). The arched structure also enables the wheel to have a greater number of teeth as compared to the prior art. By increasing the number of teeth, the number of ratcheting increments is increased, thus providing smoother and more precise ratcheting. The arched structure allows for the use or incorporation of the ratcheting mechanism in enclosed or restricted areas of a relatively small diameter. The prior art ratcheting mechanism described above was limited in the number of teeth on its wheel because the area in which the ratcheting mechanism was incorporated was of a relative small diameter (i.e., diameter of barrel 1). In the prior art, to accommodate more teeth on the wheel would require an undesirable increase in the diameter of barrel 1. The invention represents a solution to this problem.

Figure 12:
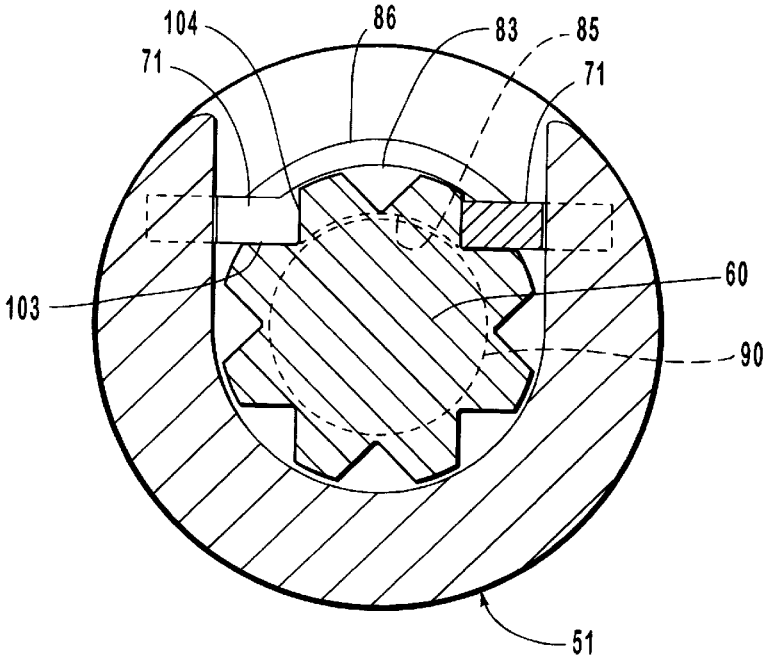
FIG. 12 depicts an end view of an alternative embodiment of the wheel and its teeth in relation to the arms of the toggles, as implemented in the invention.

It is preferred that the number of teeth 61 of wheel 60 be an even number and that said teeth be uniformly positioned around the wheel 60, for example, as shown in FIGS. 10 and 12.

It is preferred that the number and size of the teeth on the wheel be such that each adjacent pair of teeth forms a perpendicular area to receive a toggle arm. This perpendicular area is defined by an angle of about 90 degrees formed by sides 101 and 102, as shown in FIGS. 10 and 12. In other words, when arm 71 engages a tooth 61, the arm is positioned in an area defined by side 101 of one tooth 61 and side 102 of an adjacent tooth 61 as shown in FIG. 10. This is the perpendicular area, because sides 101 and 102 form an angle of about 90 degrees. This can also be seen in FIG. 12 where the number of teeth is reduced to 8, but sides 103 and 104 are approximately perpendicular and form a perpendicular area to receive arm 71.

Spindle 62, including shaft 90 and head 63, can be constructed of metal, preferably steel, but can be of any other materials suitable to serve the functions of these components. The toggles 70 and spring 24 are constructed of metal, preferably stainless steel, but can be of any other materials suitable to serve the function of the toggles and spring. The sleeve 67 can be constructed of aluminum or steel, but can be of any other materials suitable to serve the function of the sleeve. The switch is of a zinc die cast construction, but can be of any other materials suitable to serve the function of the switch.

It is further understood that there are other embodiments of and variations to this invention that will be obvious to one skilled in the art in view of the foregoing specification and the drawings, and it is intended that these embodiments and variations be included within the scope of this invention and the appended claims, which claims and their equivalents define subject matter regarded by me to be my invention.

I claim:

1. An improved toggle for a ratcheting mechanism, said toggle comprising a plate with an arched structure and an arm;

wherein said arched structure provides an arch which can be positioned above a shaft to which a ratcheting wheel with teeth is attached; and wherein said arched structure extends across the toggle; and wherein said arm is adapted to engage at least one of said teeth; and wherein said plate and arm are adapted to be positioned and used in a ratcheting mechanism that includes said ratcheting wheel with teeth.

2. A toggle in accordance with claim 1 wherein said arched structure elevates along itself and provides an elevated surface which serves as a raised area of the toggle.

3. A toggle in accordance with claim 2 wherein said arched structure expands in width along itself.

4. A ratcheting mechanism comprising:

(a) a rotatable wheel with teeth;

(b) a shaft to which the wheel is affixed;

(c) at least two toggles, each with an arm for engaging a tooth of said wheel and each with an arched structure, wherein said arched structure forms an arch over said shaft and said arched structure extends across the toggle; and (d) a contact for contacting either toggle; wherein said contacting causes the arm of the contacted toggle to disengage from a tooth of said wheel and to allow rotation of said wheel in one rotational direction.

5. A ratcheting mechanism in accordance with claim 4 wherein said contact contacts the toggle by contacting a raised area of the toggle.

6. A ratcheting mechanism in accordance with claim 5 wherein said arched structure elevates along itself and provides an elevated surface which serves as the raised area of the toggle.

7. A ratcheting mechanism in accordance with claim 6 wherein said arched structure also expands in width along itself.

8. A ratcheting mechanism in accordance with claim 4 wherein adjacent teeth of said wheel form a V-shaped notch for receiving an arm of said at least two toggles when said arm engages one of said teeth; and wherein the sides of the V-shaped notch form a perpendicular angle.

9. A ratcheting mechanism in accordance with claim 4 wherein the number of teeth of said wheel is an even number and said teeth are uniformly positioned around said wheel.

10. A ratcheting mechanism in accordance with claim 9 wherein the number of teeth of said wheel is 12.

11. A ratcheting mechanism in accordance with claim 9 wherein the number of teeth of said wheel is 8.

12. A ratcheting mechanism in accordance with claim 4 wherein the wheel with teeth has an apex; and wherein the arch allows the arms to be positioned lower in relation to said apex.

13. A ratcheting mechanism in accordance with claim 4 wherein the contact is comprised of a spring having a contact area.

14. A ratcheting mechanism in accordance with claim 13 further comprising a switch for controlling movement of said spring and for causing the contact area of said spring to make contact with either toggle.

15. A ratcheting mechanism in accordance with claim 4 wherein:

(i) said contact contacts the toggle by contacting a raised area of the toggle;

(ii) said arched structure elevates along itself and provides an elevated surface which serves as the raised area of the toggle;

(iii) adjacent teeth of said wheel form a perpendicular area for receiving an arm when said arm engages one of said teeth; and (iv) said wheel with teeth has an apex and the arch allows the arms to be positioned lower in relation to said apex.

16. A ratcheting mechanism in accordance with claim 15 wherein:

(v) the number of teeth of said wheel is an even number and said teeth are uniformly positioned around said wheel.

17. A ratcheting mechanism in accordance with claim 15 wherein:

(v) the contact is comprised of a spring having a contact area and a hole;

(vi) the ratcheting mechanism further comprises a switch for controlling movement of said spring and for causing the contact area of said spring to make contact with either toggle;

(vii) the switch is comprised of a knob for thumb or finger contact, a plate, and an extension from said plate;

(viii) said hole of said spring is sized and shaped to receive said extension from said plate.

18. A handtool comprising:

(a) a first elongated barrel having a bit-holding means on an end of said first elongated barrel, (b) a second elongated barrel having a bit-holding means on each end of said second elongated barrel, and (c) a ratcheting mechanism incorporated into the first elongated barrel;

wherein:

(i) said second barrel is rotatably attached at a fixed point to said first barrel and can be rotated about said fixed point to a position that is substantially perpendicular to said first barrel;

(ii) said bit-holding means are adapted to accept and hold bits;

(iii) said second barrel is adapted to be hand-held and to provide for increased torque when said barrel is perpendicular to said first barrel;

(iv) said first barrel has an open portion adapted to receive one end of said second barrel; and wherein said end of said second barrel can be rotated into and received by said open portion; and (v) said ratcheting mechanism is comprised of:

(1) a rotatable wheel with teeth;

(2) a shaft to which the wheel is affixed;

(3) at least two toggles, each with an arm for engaging a tooth of said wheel and each with an arched structure, wherein said arched structure forms an arch over said shaft and said arched structure extends across the toggle; and (4) a contact for contacting either toggle; wherein said contacting causes the arm of the contacted toggle to disengage from a tooth of said wheel and to allow rotation of said wheel in one rotational direction.

19. A handtool in accordance with claim 18 wherein:

(vi) said contact contacts the toggle by contacting a raised area of the toggle;

(vii) said arched structure elevates along itself and provides an elevated surface which serves as the raised area of the toggle;

(viii) adjacent teeth of said wheel form a perpendicular area for receiving an arm when said arm engages one of said teeth; and (ix) said wheel with teeth has an apex and the arch allows the arms to be positioned lower in relation to said apex.

20. A handtool in accordance with claim 19 wherein:

(x) the contact is comprised of a spring having a contact area and a hole;

(xi) the ratcheting mechanism further comprises a switch for controlling movement of said spring and for causing the contact area of said spring to make contact with either toggle;

(xii) the switch is comprised of a knob for thumb or finger contact, a plate, and an extension from said plate; and (xiii) said hole of said spring is sized and shaped to receive said extension from said plate.

* * * * *